US008414359B2

(12) United States Patent
Seyffert et al.

(10) Patent No.: US 8,414,359 B2
(45) Date of Patent: Apr. 9, 2013

(54) FLUID JET MANIFOLD

(75) Inventors: Casparus Jan Hendrik Seyffert, Solvang, CA (US); Andrey D. Atanassov, Sarasota, FL (US)

(73) Assignee: Cobra North America, LLC, Denver, CO (US)

( * ) Notice: Subject to any disclaimer, the term of this patent is extended or adjusted under 35 U.S.C. 154(b) by 839 days.

(21) Appl. No.: 12/512,910

(22) Filed: Jul. 30, 2009

(65) Prior Publication Data

US 2010/0093262 A1 Apr. 15, 2010

Related U.S. Application Data

(60) Provisional application No. 61/137,600, filed on Jul. 30, 2008.

(51) Int. Cl.
*B24C 7/00* (2006.01)

(52) U.S. Cl.
USPC ..... 451/99; 451/75

(58) Field of Classification Search ..... 451/90, 451/99, 75, 102, 38, 39, 40
See application file for complete search history.

(56) References Cited

U.S. PATENT DOCUMENTS

| | | | | |
|---|---|---|---|---|
| 835,541 | A | 11/1906 | Leisegang | |
| 1,655,767 | A | 1/1928 | Hoevel | |
| 2,038,249 | A | 4/1936 | Stoody | |
| 2,792,671 | A | 5/1957 | Sprigg et al. | |
| 4,901,928 | A | 2/1990 | Abbott et al. | |
| 5,083,402 | A * | 1/1992 | Kirschner et al. | 451/38 |
| 5,407,379 | A * | 4/1995 | Shank et al. | 451/99 |
| 5,605,496 | A * | 2/1997 | Pickard | 451/90 |
| 2009/0250231 | A1 * | 10/2009 | Larsson | 169/70 |

OTHER PUBLICATIONS

Fairhurst, R.M. et al., "Diajet—A New Abrasive Water Jet Cutting Tool," Proceedings of the 8th International Symposium on Jet Cutting Technology, Durham, UK, Sep. 9-11, 1985, pp. 395-402.

Summers, D.A., "Waterjetting Technology," Chapters 1 through 12, published by E & FN Spon, an imprint of Chapman & Hall, London, UK, 1995.

Graettinger, A.J. et al., "Foundation Evaluation with Micro Intrusive Testing," University Transportation Center for Alabama (UTCA), University of Alabama, UTCA Report No. 01114, Dec. 2002, 36 pages.

Jetstream of Houston, Inc., Catalog, http://www.asiawaterjet.com/Jetstream-2520MainCatalog.pdf, 1998.

A typical spraying gun that might be attached to a garden hose, http://www.aquatix-2u.co.uk/acatalog/adjustable-car-care-spray-gun.html, downloaded Dec. 28, 2010, 1 page.

(Continued)

*Primary Examiner* — Robert Rose
(74) *Attorney, Agent, or Firm* — HolzerIPLaw, PC

(57) ABSTRACT

A fluid jet system providing a hydraulic induction manifold for at least two valves. The manifold is positioned "upstream" of an abrasives holding tank, so that no abrasive material flows through the valves and the manifold. The valves and the manifold provide pressurized fluid for at least two different flows: (1) a primary fluid flow and (2) an abrasive material flow through the abrasives holding tank. The two flows are merged again at a junction to provide a fluid flow having a predetermined abrasive-to-fluid mixture ratio. The manifold balances the pressure of the two different flows using a preset geometric relationship between the two different output flow paths associated with the valves.

20 Claims, 11 Drawing Sheets

OTHER PUBLICATIONS

A higher pressure control system, http://www.northerntool.com/shop/tools/product_273_273, downloaded Dec. 28, 2010, 2 pages.
A lance extension to fit into a pressure washer gun, http://www.pressureparts.com/ImageView.aspx?code=4760262, downloaded Dec. 28, 2010, 1 page.
A conventional high pressure cleaning lance, http://www.advancedpressuresystems.com/40K-Water-Blasting-Products.htm?cat=10, downloaded Dec. 28, 2010, 2 pages.
A two-trigger gun, http://www.advancedpressuresystems.com/APS-control-gun-html?cat=5, downloaded Dec. 28, 2010, 2 pages.
A disassembled two-trigger gun, http://www.advancedpressuresystems.com/images/PDF/15K-Hand%20Guns-2010-Catalog-Pages.pdf, downloaded Dec. 28, 2010, 1 page.
Ultra-high pressure nozzle assemblies, http:www.alljetting.com/controlguns.htm, downloaded Dec. 28, 2010, 1 page.
An ultra-high pressure cleaning lance assembly, http://www.alljetting.com/controlguns.htm, downloaded Dec. 28, 2010, 1 page.
An abrasive injection lance, http://www.aquamiser.com/blasting-guns.html, downloaded Dec. 28, 2010, 1 page.
A high-pressure gun with hose connection in front of the trigger, http://woma-products.com/pdf/p_tools_e.pdf, downloaded Dec. 28, 2010, 1 page.
Protective pipe in tube cleaning, http://www.peinemannequipment.com/products.bundle_cleaning/single_lance_tube_cleaner/, downloaded Dec. 28, 2010, 2 pages.

* cited by examiner

FLUID JET MANIFOLD

CROSS-REFERENCE TO RELATED APPLICATIONS

The present application claims benefit of priority to U.S. Provisional Patent Application No. 61/137,600, entitled "Ultra High Pressure Fire Attack System" and filed on Jul. 30, 2008, specifically incorporated by reference herein for all that it discloses or teaches.

The present application also relates to U.S. Nonprovisional patent application Ser. No. 12/512,874, entitled "Fluid Jet Assembly" and filed on Jul. 30, 2009, specifically incorporated by reference herein for all that it discloses or teaches.

BACKGROUND

Fluid jet systems have many applications, such as firefighting, surface cleaning, hydroexcavation, demolition, machining, mining, etc. Typical fluid jet systems provide a cutting or abrading function by projecting a jet of fluid at high velocity and pressure at a structure or surface. The specific fluid employed depends on the application. For example, for firefighting applications, a combination of water and an abrasive material may be employed to penetrate a wall or ceiling of a structure having a fire within, and upon creating a hole in the wall or ceiling, the abrasive material flow may be terminated while continuing the water flow through the hole to knock down the fire.

However, existing fluid jet systems have certain design features that present safety and maintenance concerns. High pressure fluids present safety risks, particularly when operated near humans and property. For example, a high pressure coupling positioned near an operator's head presents a risk that the coupling may fail during operation, after which the high pressure hose can whip about until the pressure is terminated.

Further, the use of an abrasive material presents challenges in maintaining the system components. For example, pumps and valves tend to break down quickly if abrasive material flows through the components.

SUMMARY

Implementations described herein address the foregoing problems by providing a hydraulic induction manifold block for at least two valves. The manifold is positioned "upstream" of an abrasives holding tank, so that no abrasive material flows through the valves and the manifold. The valves and the manifold block provide pressurized fluid for at least two different flows: (1) a primary fluid flow and (2) an abrasive material flow through the abrasives holding tank. The two flows are merged again at a junction to provide a fluid flow having a predetermined abrasive-to-fluid mixture ratio. The manifold block balances the pressure of the two different flows using a preset geometric relationship between the two different output flow paths associated with the valves.

Other implementations are also described and recited herein.

BRIEF DESCRIPTIONS OF THE DRAWINGS

DETAILED DESCRIPTIONS

Figure 1:
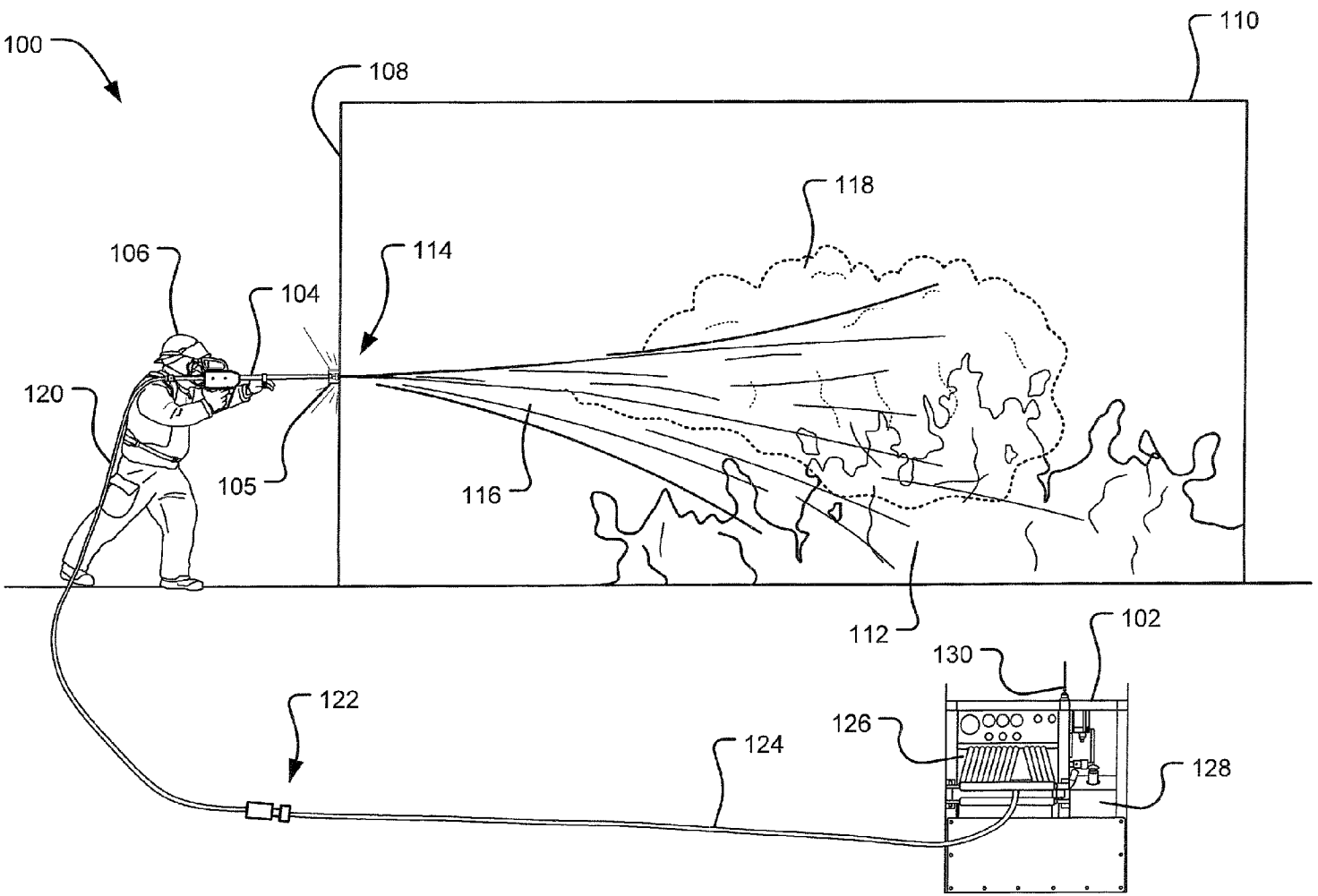
FIG. 1 illustrates an example of a fluid jet system used in a firefighting application, the example fluid jet system including a fluid jet base station and a fluid jet assembly.

FIG. 1 illustrates an example of a fluid jet system 100 used in a firefighting application, the example fluid jet system including a fluid jet base station 102 and a fluid jet assembly 104 (also referred to as lance 104). Example fluids may include without limitation water, combinations of water and an abrasive material, combinations of water and foam, etc. The specific fluid employed depends on the application. Under certain circumstances, for example, a flow of fire retardant foam may be combined with the water flow to enhance the suppression of the fire (e.g., coating the fire's fuel to reduce its contact with oxygen).

In the example shown in FIG. 1, a firefighter 106 is shown holding the distal end of the lance 104 against a wall 108 (or door) of an enclosure 110 in which a fire 112 is burning. The lance 104 includes a rigid lance barrel through which high pressure fluid flows during operation. The rigid lance barrel allows the firefighter 106 to accurately direct the fluid flow and to steady the lance 104 against a surface, such as the wall 108. The firefighter 106 initially cuts through the wall 108 using a combined flow of high pressure water and abrasive material. When the wall 108 is penetrated, the firefighter ceases the flow of abrasive material while continuing the flow of water, which streams into the enclosure 110 through the newly cut hole 114 in the wall 108 in a high pressure jet 116 having small water droplet size (e.g., approximately 0.0059 inches or 150 microns in diameter) and a high velocity (e.g., approximately 400-450 mile per hour or 200 meters per second). The water characteristics are such that water jet extends a considerable distance (e.g., over 40 feet) into the enclosure 110, despite convection currents caused by the fire 112, and knocks down the fire 112. Much of the water in the high pressure jet 116 is vaporized (as shown by steam 118), reducing the intensity of the fire 112 and the temperature in the enclosure 110. In this manner, the fluid jet system 100 knocks down the fire and makes it safer for firefighters to enter the enclosure 110 to progress their firefighting activities. However, it should be understood that technology described and claimed herein may be employed in other applications, including surface cleaning, hydroexcavation, demolition, machining, mining, etc.

In preparation for applying the fluid jet system 100 to the fire 112 in the enclosure 110, the firefighter 106 takes a steady stance, holds the lance 104 against his shoulder and with both hands (e.g., one hand in the trigger guard of the lance 104 and the other on a handle located forward of the trigger guard on the lance barrel), and places a placement structure at the distal end of the lance 104 against the wall 108. In one implementation, the placement structure is embodied by a 3-pronged offset fixture with a splash plate to protect the operator from spray-back of fluid and debris during the cutting operation. Other placement structures may be employed to steady or aim the fluid jet at a target region of a structure. In some implementations, cutting performance of the fluid jet is improved if the placement structure allows the operator to "wiggle" the fluid jet about the target region. In this manner, the hole that is cut in the structure by the fluid jet develops as larger diameter than the fluid jet itself, thereby allowing fluid and debris to evacuate during the cutting operation.

In the illustrated implementation, the lance 104 includes two triggers: (1) a trigger to control the flow of water from the fluid jet base station 102 through the lance 104; and (2) a trigger to control the flow of abrasive material from an abrasives holding tank in the fluid jet base station 102 through the lance 104. To commence the cutting stage, the firefighter 106 pulls both triggers and a combined flow of water and abrasive material flows at high velocity against the wall 108, quickly cutting a small hole through the wall 108. After the wall 108 is penetrated by the water/abrasive material combination, the firefighter 106 releases the abrasive material trigger and continues the flow of high pressure water through the lance 104, through the hole in the wall 108, and into the enclosure 110 to knock down the fire 112.

The lance 104 includes a lance hose 120, which threads through the barrel of the lance 104 and is anchored to the distal end of the lance 104. The lance hose 120 threads out of the proximal end of the lance 104 a safe distance (e.g., from a few feet to over several yards away) away from the firefighter 106 to a high pressure coupling 122, which couples the lance hose 120 to a base station hose 124.

The fluid jet base station 102 includes a motorized hose reel 126 that allows the base station hose 124 to be extended during operation and retracted during storage. In the illustrated implementation, the fluid jet base station 102 also includes, among other components, a power source (such as a diesel or gasoline engine), a fluid source (such as a water intake hose or reservoir), an abrasives holding tank 128, a communications system (see antenna 130), a high pressure pump, multiple valves with one or more valve manifolds, and a flow junction for combining multiple flows (e.g., a water flow and an abrasive material flow).

Figure 2:
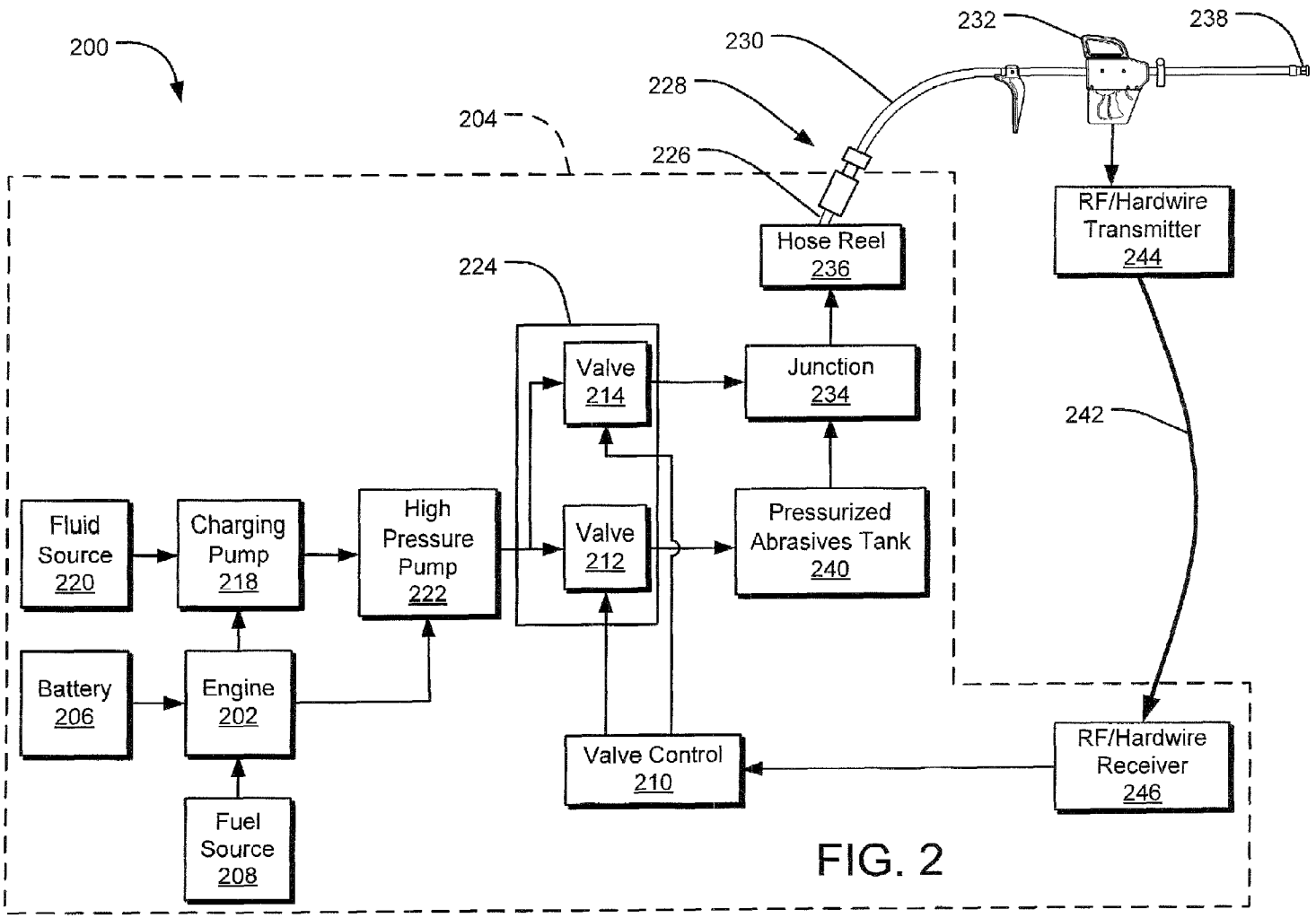
FIG. 2 illustrates a hydraulic schematic of an example fluid jet system.

FIG. 2 illustrates a hydraulic schematic of an example fluid jet system 200. An engine 202 powers a fluid jet base station 204. In one implementation, the engine 202 is embodied by a single DEUTZ naturally aspirated 50 hp diesel engine, although other engines or power sources may be employed, including gasoline engines, electric motors, hybrid engines, etc. In the system illustrated in FIG. 2, an electricity source, such as a battery 206, provides electrical power for an automatic ignition used to start the engine 202 and a fuel source 208 (e.g. a diesel fuel tank) provides fuel to the engine 202. The battery 206 also provides power to a valve control circuit 210, valves 212 and 214 and a radio frequency (RF) or hardwire receiver 216. Although more than one engine may be employed, the single normally aspirated DEUTZ air cooled diesel engine 202 provides consistent power and allows sufficient operation under almost any weather conditions and altitudes. Further, the engine 202 provides a very short start-up time and rapid deployment of the fluid jet system 200 without complicated control systems and frequent maintenance.

The engine 202 provides power to a charging pump 218, which pulls fluid from a fluid source 220, such as a water intake or reservoir, and provides a fluid flow with positive pressure for the input of a high pressure pump 222. The high pressure pump 222 is driven by the main shaft of the engine 202 via a poly carbon drive belt. In one implementation, the pump 222 is capable of discharging fluid at a pressure of approximately 4,400 PSI (300 bar) at a flow rate of 15 gallons per minute (GPM) (60 liters per minute) via 1.2 inch outer diameter, 0.5 inch inner diameter high pressure hose system (e.g., a base station hose 226, a coupling 228, and a lance hose 230). It should be understood that other dimensions of hose may also be employed.

In one implementation, the pump 222 may be embodied by a single UDOR ultra high pressure force pump having dimensions of 15"L×16.5"W×9"H, although other pump assemblies may be employed. An example pump 222 may include without limitation a 35 mm solid keyed shaft, a brass manifold, a stainless steel check valve, stainless steel plungers, bronze connecting rods, tapered roller bearings, solid ceramic plungers, a heat treated crankshaft, a heavy duty flat base, high pressure seals, and an 80 oz oil crank case, although other designs may be employed.

The pump 222 drives fluid at high pressure into the valves 212 and 214, which are set in a manifold 224. The valves 212 and 214 are independently controlled by the valve control circuit 210, which can be controlled wirelessly or via a hardwired communications link from a lance 232, or alternatively via a manual override circuit having access to the base station 204.

The valve 214 drives high pressure fluid through the junction 234 and the hose reel 236 into the high pressure hose assembly, through the lance 232 and out a nozzle 238 of the lance 232. The other valve 212 feeds into a pressurized abrasives holding tank 240, which contains abrasive material that improves the cutting performance of the fluid flow during a cutting stage of operation. In one implementation, the pressurized abrasives holding tank 240 is a 2.5 gallon vessel mounted to the base station 204. An abrasive material, such as PYROSHOT abrasive additive, another inert, non-metallic abrasive material, such as sand, diamond-cut granite, ground garnet, etc., or some other abrasive material, is loaded into the abrasives holding tank, 240 which is then pressurized with fluid flow from the value 212 when the valve 212 is opened. When the valve 212 drives pressurized fluid through the abrasives holding tank 240, a combination of fluid and abrasive is driven to a junction 234, where it combines with the fluid flow from the valve 214. As such, when both valve 212 and valve 214 are open, a combination of abrasive material and fluid is driven out of the abrasives holding tank 240 and through the high pressure hose assembly and the lance 232 to the nozzle 238 for application to a target surface, such as to cut through a structure or clean the target surface.

In one implementation, a single manifold block 224 contains the valves 212 and 214 and regulates the pressure of the fluid flow output from each valve to achieve a desired mixture ratio of abrasive material to fluid, although it should be understood that each valve 212 and 214 may have its own separate containment. In one implementation, 5% of the fluid output from the lance 232 is abrasive material, although other mixture ratios may be employed. For example, 8% is also proposed as an effective mixture ratio. It is believed that a mixture ratio of between 2.5% and 40% may be acceptable, but for some applications, the mixture ratio may fall outside of this range. To achieve a desired mixture ratio, considering the additional hydraulic resistance introduced in the abrasives line by the abrasive holding tank 240, the individual outputs of each valve 212 and 214 are fed through individual channels of the manifold 224, wherein each manifold channel is preconfigured to achieve the appropriate abrasive-to-fluid mixture ratio.

The valves 212 and 214 can be controlled remotely from the lance 232 via a wireless (RF) or hardwired communications link 242. A transmitter 244 in (or communicatively coupled to) the lance 232 transmits signals to a receiver 246 in (or communicatively coupled to) the base station 204. The lance 232 includes separate triggers to independently control the flows of fluid and abrasive material through the system (although, in one implementation, abrasive material flow fed by the valve 212 is restricted when no fluid flows through valve 214). Each trigger sends signals to the base station 204 to open or close the valves 212 and 214. An operator can close neither trigger (e.g., the system is in standby mode), one of the triggers (e.g., typically, only fluid without abrasive material flows), or both triggers (e.g., both fluid and abrasive material flows). For example, to execute a cutting operation, a firefighter closes both triggers to cut a hole in a structure using a high pressure combination of water and abrasive material; to execute the knock down operation on the fire, the firefighter closes only the trigger controlling the valve 214, which provides high pressure water through the newly cut hole and into a burning room on the other side of the structure.

FIGS. 3-7 illustrate various views of a fluid jet base station 300 for an example fluid jet system, although it should be understood that alternative implementation may be employed. Various components of the base station 300 may be found in any of FIGS. 3-7, although such components may be discuss with regard to a specific Figure even if the component is not visible in that Figure.

Figure 3:
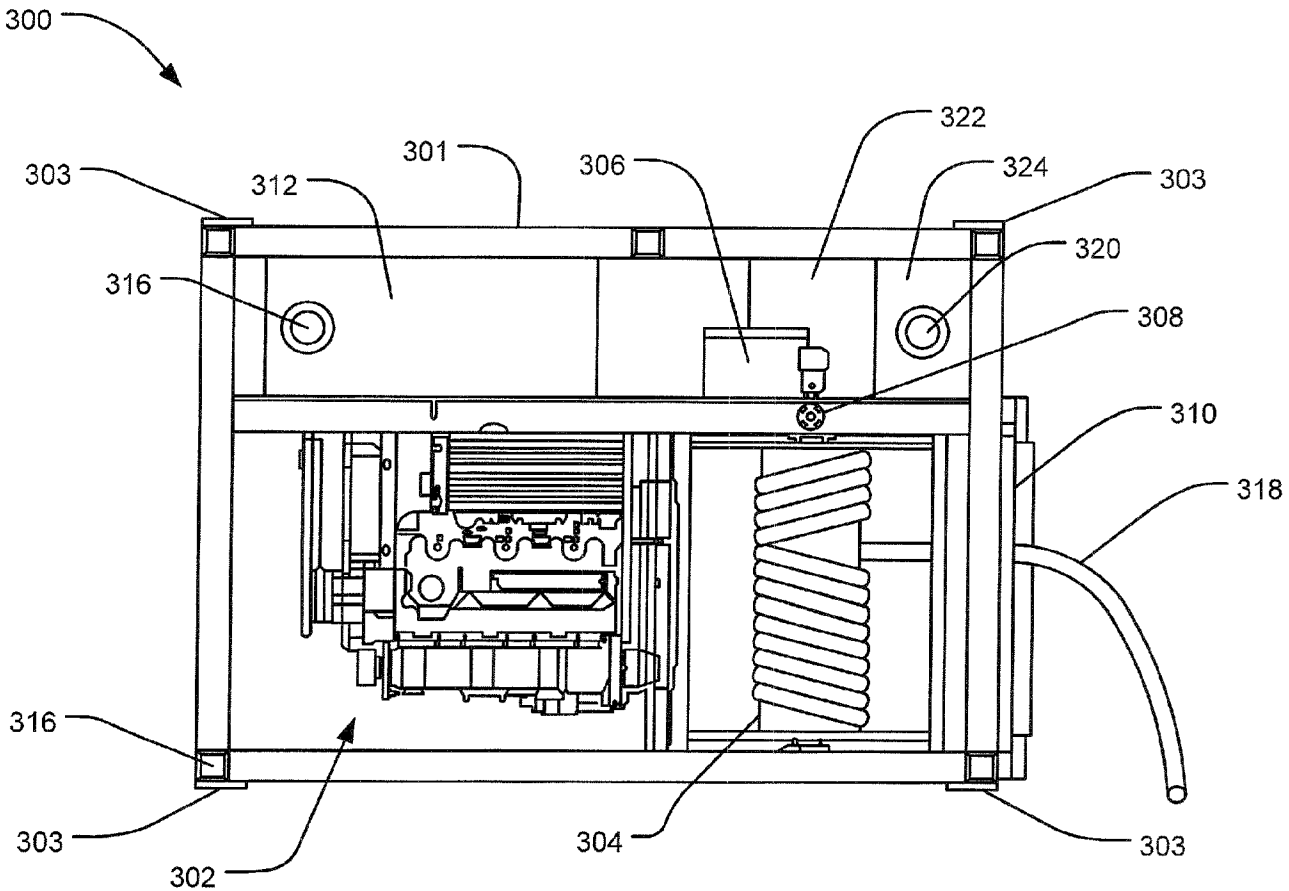
FIG. 3 illustrates a plan view of a fluid jet base station for an example fluid jet system.

FIG. 3 illustrates a plan view of a fluid jet base station 300 for an example fluid jet system. The base station 300 is generally housed within a sturdy steel frame 301. In one implementation, the frame 301 is 48 inches by 34 inches by 36 inches, and the self-contained base station 300 weighs approximately 1500 pounds. The frame 301 includes several sturdy steel eyelets 303 to facilitate transport of the base station 300 to a location of operation (e.g., the eyelets can receive cabling to secure the base station 300 on a truck or fork lift).

The base station 300 is powered by an engine 302 to drive a charging pump, if appropriate, and a high pressure pump 332 (see FIG. 7) and provides electrical power to a motorized hose reel 304, a communications system (see receiver module 306 and antenna 308), and a control system (see control panel 310). The engine 302 receives fuel from a fuel tank 312 and electrical current from a battery 314 (see e.g., FIG. 4). Access to the fuel tank 312 (e.g., for refueling) is provided through fuel input 316.

The base station 300 includes the hose reel 304, which allows or employs a motor to assist extension of the base station hose 318 as the operator carries the lance (see e.g., lance 104 of FIG. 1) to a remote location (e.g., to an outside wall of a burning structure). The base station hose 318 is typically connected to a lance hose (see e.g., lance hose 120 of FIG. 1) via a high pressure coupling (see e.g., coupling 122 of FIG. 1). The motor of the hose reel 304 also assists with retraction of the base station hose 318 when extending the base station hose 318 is no longer needed.

The base station 300 also includes a pressurized abrasives holding tank 326 (see FIG. 4 and see e.g., abrasives holding tank access 320 and faces 322 and 324 of the abrasives holding tank compartment in FIG. 3) that stores abrasive material and feeds the abrasive material into the fluid flow during a cutting operation. The high pressure pump 332 drives fluid at a high pressure into the abrasives holding tank 326 (see FIG. 4) when the appropriate manifold valve is open. It should be understood that cutting is merely an example application of the abrasive material flow. Other applications, such as surface cleaning, hydroexcavation, demolition, drilling, mining, etc. may also employ an abrasive material flow.

Figure 4:
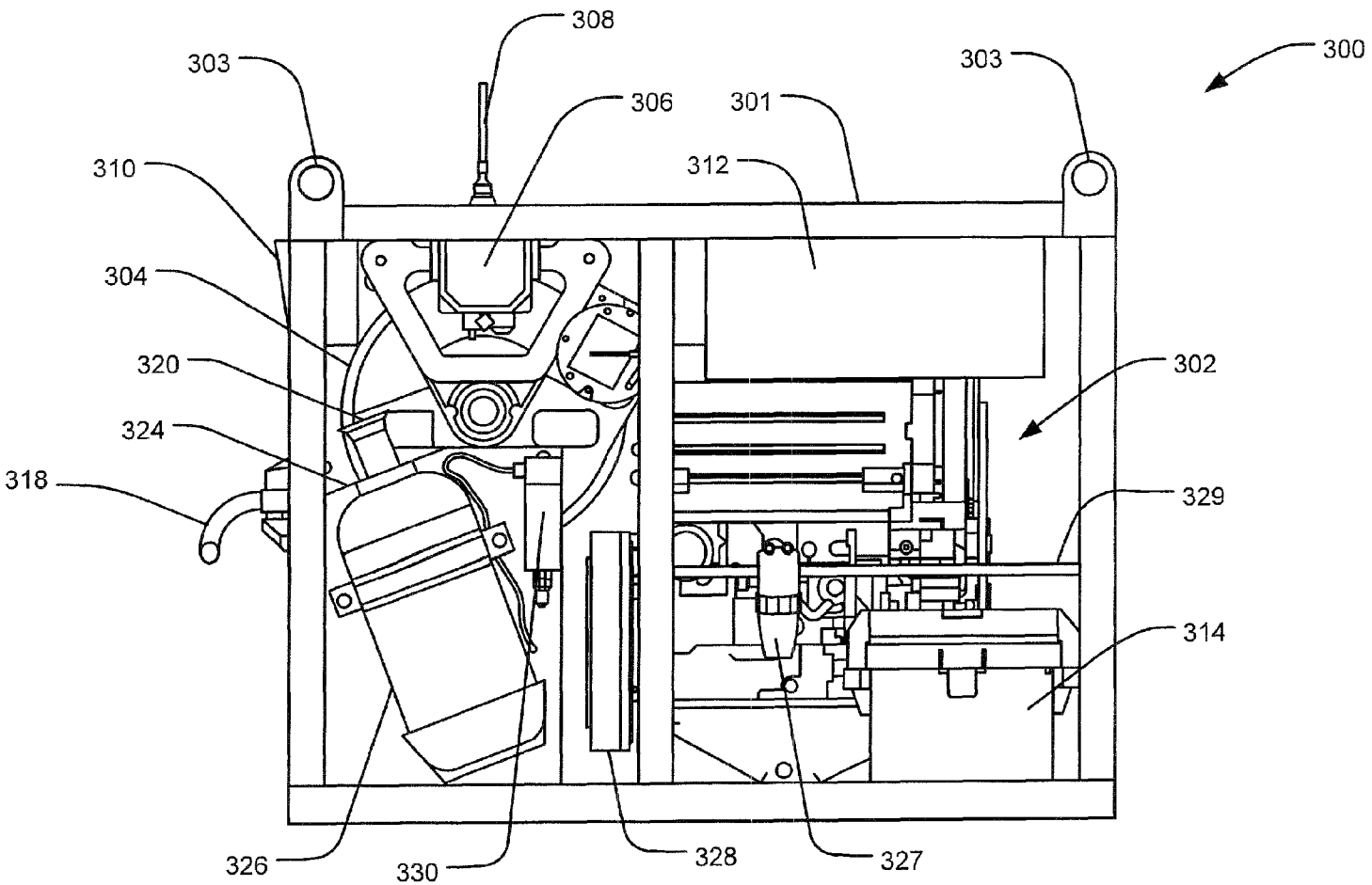
FIG. 4 illustrates a right side view of a fluid jet base station for an example fluid jet system.

FIG. 4 illustrates a right side view of a fluid jet base station 300 for an example fluid jet system. The engine 302 is shown with the fuel tank 312 and battery 314. A drive belt drive 328 is shown powered by the engine 302. The drive belt 328 drives the high pressure pump 332 (see FIG. 7). An inline filter 327 is shown with an intake pipe 329 (extending from the periphery of the base station 300 and connecting to the side of the inline filter 327) and an outlet pipe (extending from the other side of the inline filter 327 into the interior of the base station 300 to feed into the high pressure pump 332). The intake pie 329 can be connected to a fluid source, such as a hose from a fluid reservoir of a nearby fire truck. In one implementation, an inline charging or supply pump (not shown) may also be used to maintain input pressure on the high pressure pump 332. This charging or supply pump may be driven by a second drive belt (not shown) powered by the engine 302.

The engine 302 and the other components of the base station are mounted to the frame 301, which has eyelets to assist with transport. An antenna 308, with receiver module 306, is mounted at the top of the frame 301 to facilitate reception of wirelessly transmitted commands from the lance. A control panel 310 is mounted on the front of the frame 301 to present gauges and various operator-accessible controls. The base station hose 318 extends out the front of the base station 300 from the motorized hose reel 304.

An abrasive material tank 326 is contained within an abrasives holding tank compartment (see e.g., compartment face 324). Two manifold valves and a shared manifold 330 are mounted within the abrasives holding tank compartment to regulate the flows of fluid and abrasive material. The inputs to the valves are driven by the high pressure pump 332 and the manifold 330 has output for each valve, one of which feeds into the abrasives holding tank 326 and the other which feeds into a junction (not shown) to combine with output flow from the abrasives holding tank 326.

Figure 5:
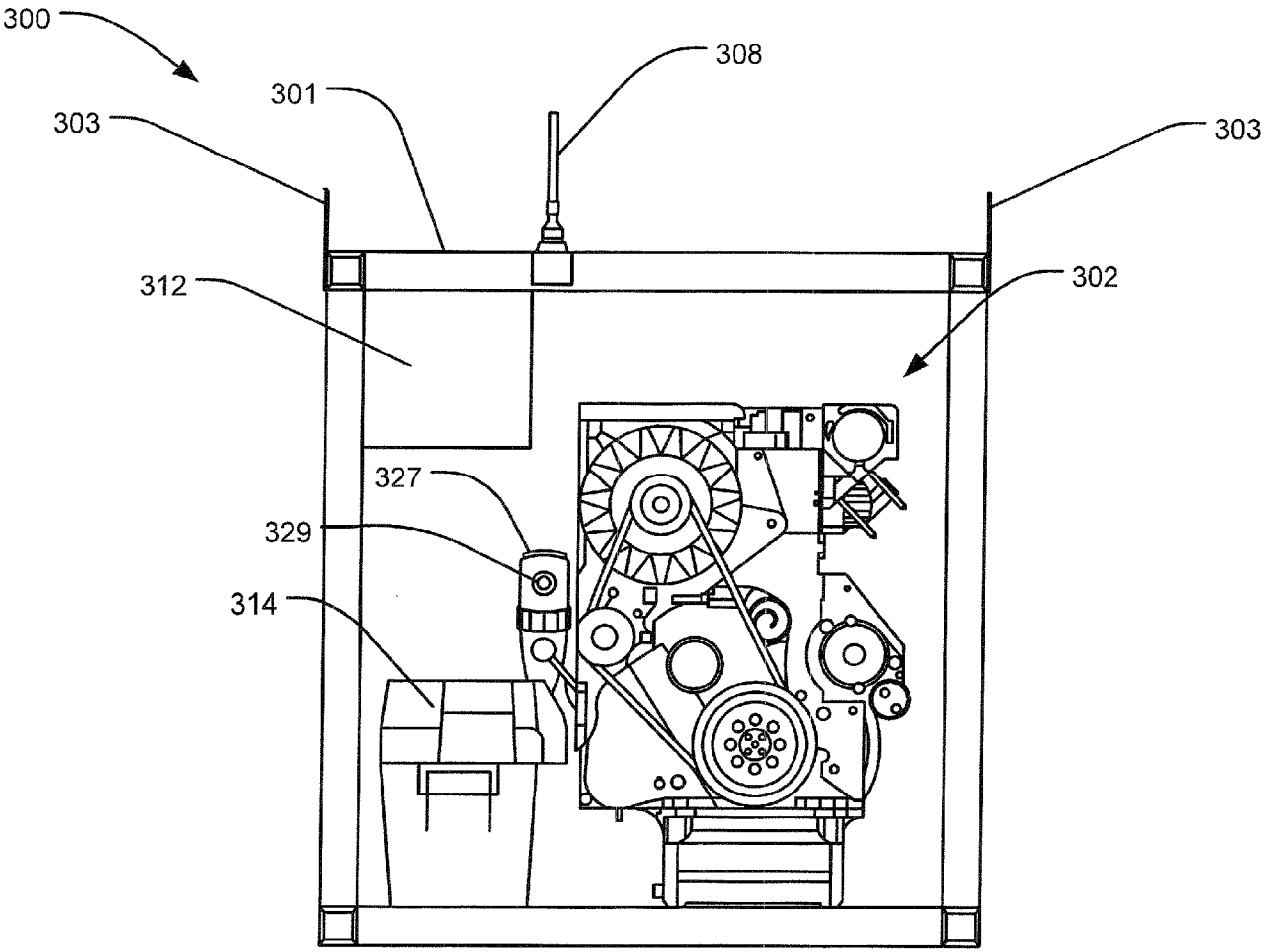
FIG. 5 illustrates a back view of a fluid jet base station for an example fluid jet system.

FIG. 5 illustrates a back view of a fluid jet base station 300 for an example fluid jet system. A majority of the base station components are not visible in the view for FIG. 5. Nevertheless, the engine 302, the battery 314, the fuel tank 312, the eyelets 303, the inline filter 327, the intake pipe 329, and the antenna 308 are illustrated in FIG. 5 being mounted to the frame 301.

It should be understood, however, that alternative implementations may be employed. For example, in one implementation, the fluid jet base station is mounted in or to a vehicle for transport. For example, components of the base station may be separately mounted to a fire department vehicle and powered by an auxiliary drive train connected to the vehicle's engine. The hose reel is mounted to an operator-accessible compartment on the vehicle to allow an operator to connect the base station hose to a lance hose. The operator can then extend the base station hose to pull the lance into the specific area of operation (e.g., against a wall to a burning structure).

Figure 6:
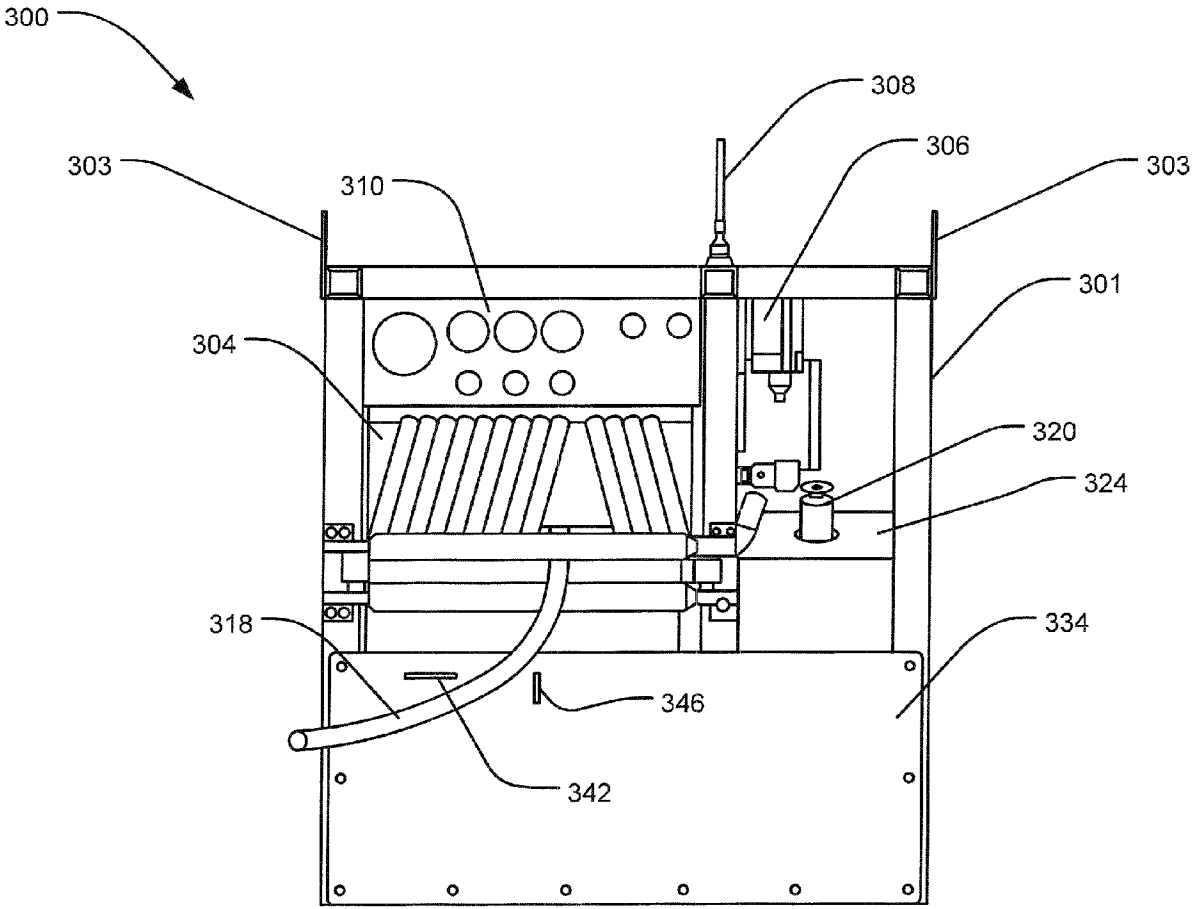
FIG. 6 illustrates a front view of a fluid jet base station for an example fluid jet system.

FIG. 6 illustrates a front view of a fluid jet base station 300 for an example fluid jet system. The frame 301 is shown supporting the antenna 308, a receiver module 306, the abrasives holding tank compartment 324 with tank access 320, the motorized hose reel 304, and the control panel 310. The base station hose 318 extends from a railed opening mounted on the frame 301 in front of the hose reel 304. A kick plate 324 is also mounted on the frame 301. The high pressure pump 332

(see FIG. 7) is mounted to the frame 301 behind the kick plate 324, beneath the hose reel 304. Eyelets 303 are shown at the top of the frame 301.

A priming pump handle 342 for a priming pump 344 is accessible through the kick plate 334 to allow an operator to manually prime the high pressure pump 332 (e.g., by pulling the priming pump handle 342 in and out relative to the priming pump 344). During a priming operation, a priming valve control 346, also accessible through the kick plate 334, is set to a horizontal priming position. After a priming operation, the priming valve control 346 is set to a vertical normal operation position.

Figure 7:
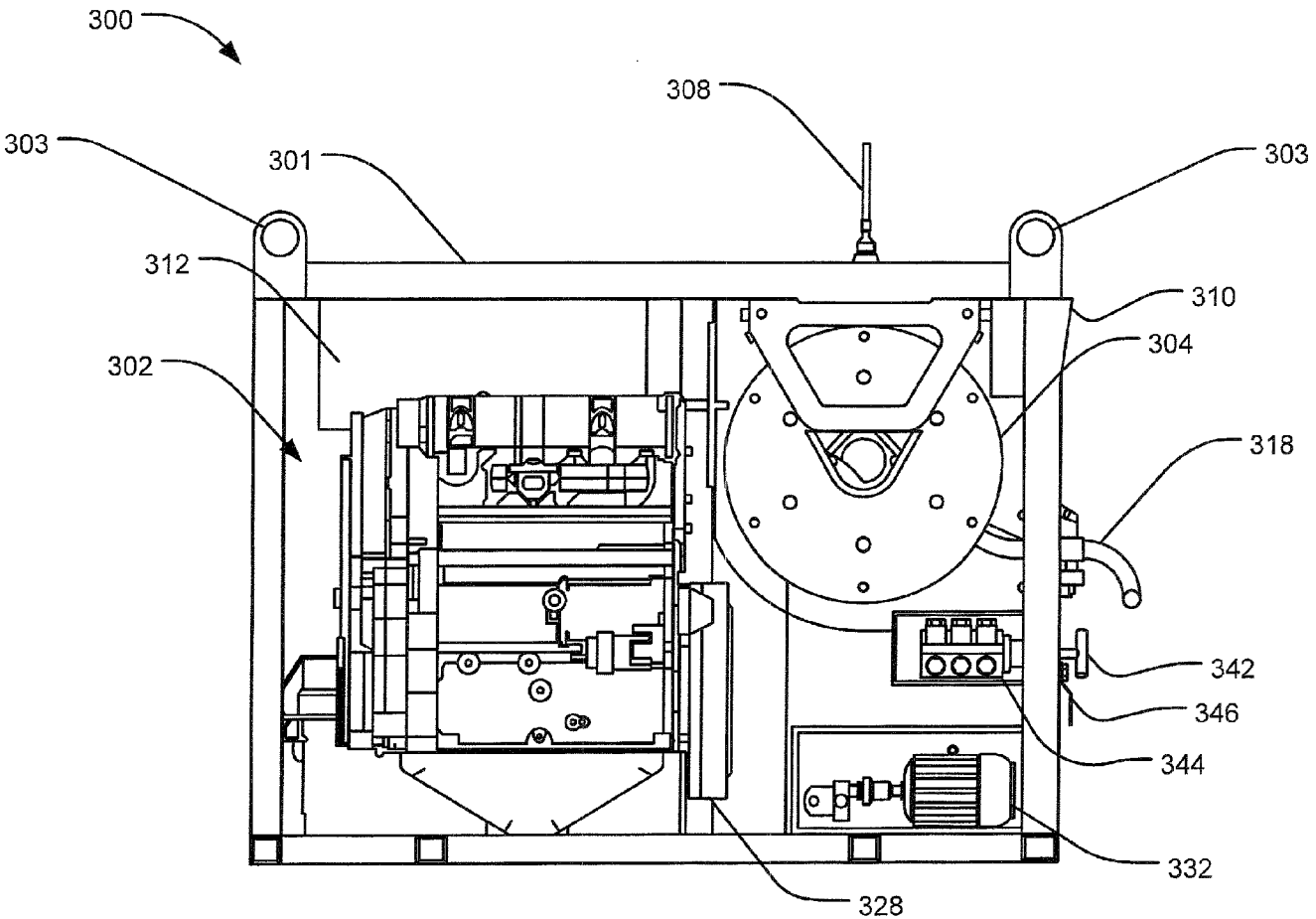
FIG. 7 illustrates a left side view of a fluid jet base station for an example fluid jet system.

FIG. 7 illustrates a left side view of a fluid jet base station 300 for an example fluid jet system. The frame 301 is shown supporting the antenna 308, the eyelets 303, the control panel 310 the hose reel 304, the high pressure pump 332, the engine 302, and the fuel tank 312.

The pump 332 is coupled by drive belt 328 to the main shaft of the engine 302. Although not shown in FIG. 7, the charging pump is also coupled to the main shaft of the engine by another drive belt (see drive belt 328 of FIG. 4). The high pressure pump 332 drives fluid under high pressure into the manifold valves and manifold 330. The high pressure fluid stream emanating from the base station 300 flows through the base station hose 318 when one or more of the valves are open and the pump 332 is providing pressure to the flow.

Figure 8:
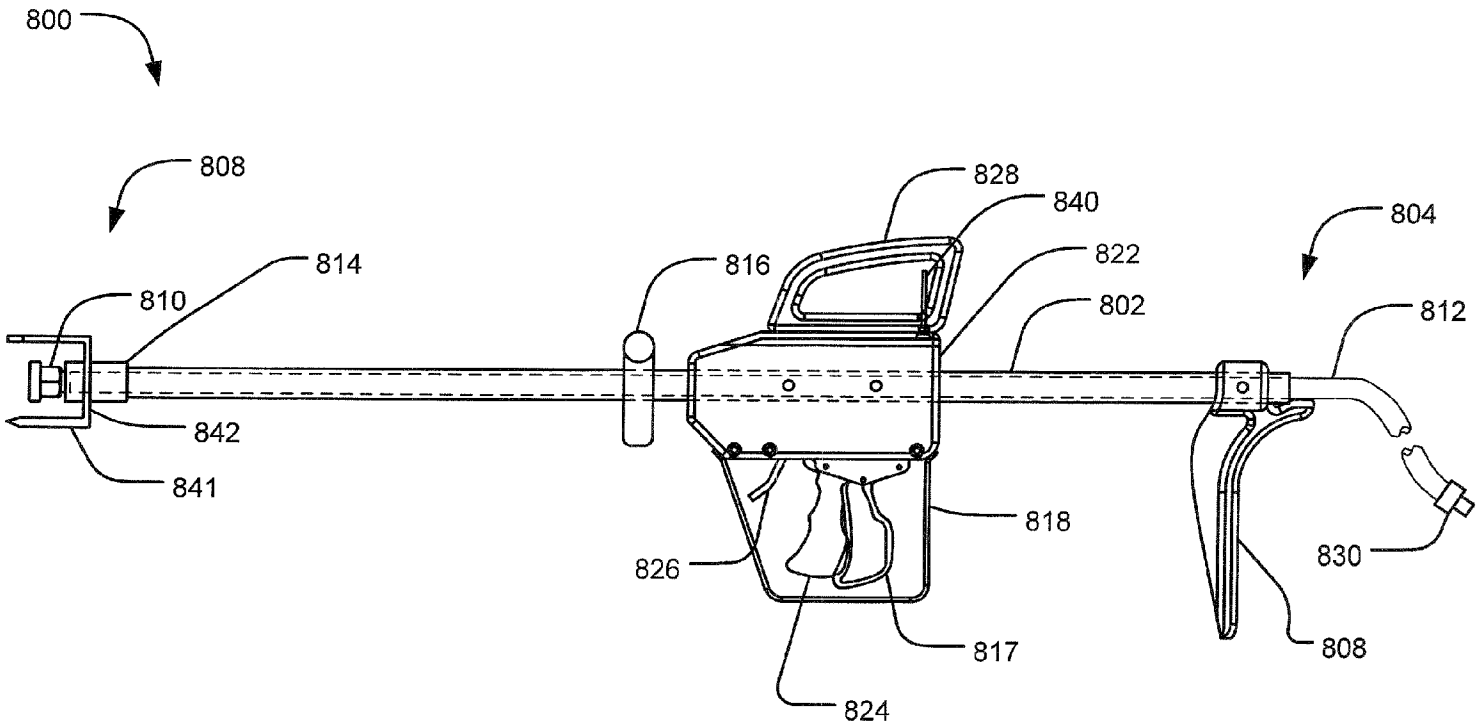
FIG. 8 illustrates a fluid jet assembly for an example fluid jet system.

FIG. 8 illustrates a fluid jet assembly 800 (also referred to as lance 800) for an example fluid jet system. A rigid, hollow lance barrel 802 extends between a proximal end 804 and a distal end 806. A shoulder support 808 is mounted to the lance barrel 802, positioned at the proximal end 808, to provide additional support to an operator operating the fluid jet assembly 800. A nozzle 810 on the distal end 806 shapes the characteristics of the fluid stream as it exits the fluid jet assembly 800.

During operation, the high pressure lance hose 812 is pressurized with a high pressure fluid flow from the base station (see base station 300 in FIGS. 3-7). The lance barrel 802, however, is not pressurized. Instead, a high pressure lance hose 812 threads through the lance barrel 802 between proximal end 804 and the distal end 806 and is anchored (e.g., fixedly secured) at the distal end 806 of the lance barrel 802 by an anchor point 814 and contains the high pressure fluid. In this manner, the high pressure lance hose 812 bears the pressure of the fluid flow while the rigid lance barrel 802 provides a stiff structure to allow the operator to direct the fluid jet when it exits the nozzle 810. For example, in a surface cleaning application, the operator can aim the fluid jet using the rigid lance barrel 802, much as one might aim with a barrel of a firearm.

The rigid lance barrel 802 also provides support when the operator presses the distal end of the lance barrel 802 against a structure for cutting. In one implementation, an offset fixture (not shown) may be attached to the distal end of the lance barrel 802 to hold the nozzle 810 a short distance away from the structure. As such, during operation, the fluid jet is directed at a small point or area of the structure in order to cut through the structure, and waste fluid and debris can be evacuated from the cutting area in the offset distance enforced by the offset fixture.

The lance hose 812 extends out the proximal end 804 of the lance barrel 802 and away from the proximal end 804 for a substantial distance to provide a safe separation between the operator and a coupling 830 (see also e.g., coupling 122 in FIG. 1) to the base station hose (see base station hose 124 in FIG. 1). In this manner, a operator is safely protected from two high pressure points of possible failure in the fluid jet system, (1) the anchor point 814 at the distal end 806 of the fluid jet assembly 800 and (2) the high pressure coupling 830 between the lance hose 812 and the base station hose.

An alternative design might include a high pressure coupling at the proximal end of the lance directly between the base station hose and the lance barrel. However, this non-optimal design introduces the risk to the operator of a high pressure coupling in the proximity of the operator's head. In addition, the lance barrel itself is pressurized, introducing yet another possible source of failure. In contrast, the fluid jet assembly 800 shown in FIG. 8 includes a separate lance hose between the base station hose coupling and the nozzle 810. In this manner, the anchor point 814 is separated from the operator by the length of lance barrel 802 while the pressurized lance hose is sheathed within the barrel, and the high pressure coupling 830 between the lance hose 812 and the base station hose is separated from the operator by a substantial distance of lance hose 812 (e.g., from a few feet to over several yards away from the operator).

When an operator is operating the fluid jet assembly 800, the operator positions the shoulder support 808 against his or her shoulder and/or upper torso and aims the nozzle 810 in the desired direction. During operation, the operator holds a barrel handle 816 with one hand and places his or her other hand within the trigger guard 817 and around the trigger post 818, both of which are mounted to a lance manifold 822. The lance manifold 822 houses a microswitch for each trigger (e.g., primary fluid flow trigger 824 and abrasive material flow trigger 826) and a wireless or hardwired transmitter to send command signals back to the base station to control the fluid flow. An antenna 840 is electrically connected to a transmitter located with in the lance manifold 822 and positioned on the top of the lance manifold 822 for communications with the base station. (In the case of a hardwired communications link between the fluid jet assembly 800 and the base station, a communications wire can be run along the lance hose 812 and the base station hose to a receiver in the base station.) To open one or more valves in the base station, the operator closes one or more of the triggers 824 and 826 toward trigger post 818. The lance manifold 822 also includes a handle 828 for easy carrying of the fluid jet assembly 800.

Although the lance hose 812 is shown threading through the lance barrel 802, other implementations may be employed in which the lance hose 812 is only partially enclosed in the lance barrel 802 or even not at all. However, enclosure of the lance hose 812 within the lance barrel 802 provides a compact design that is easy to operate while providing a rigid protective sheath to further enhance the operator's safety in case of lance hose failure or anchor point coupling failure.

Figure 9:
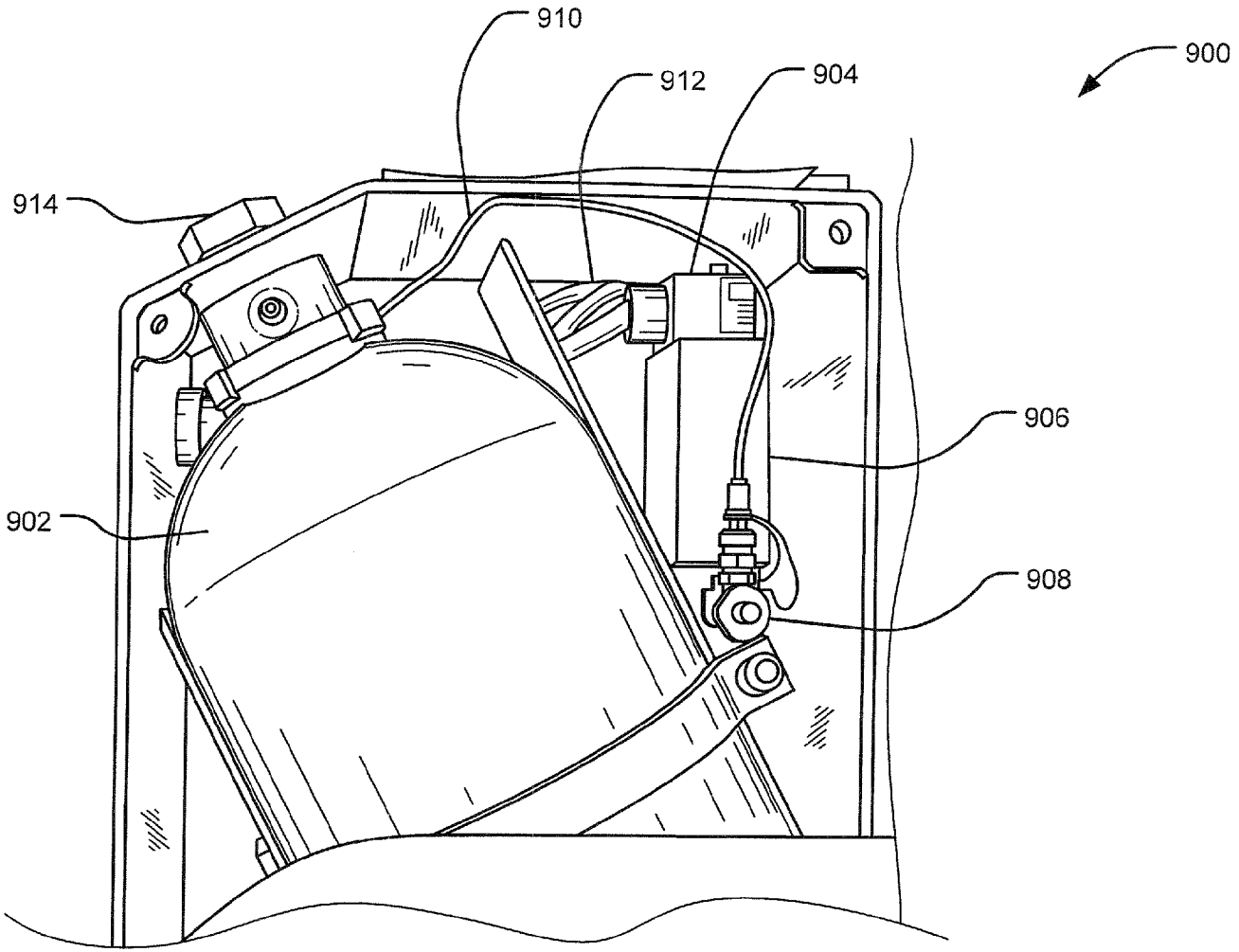
FIG. 9 illustrates an abrasives holding tank compartment in an example fluid jet system.

FIG. 9 illustrates an abrasives holding tank compartment 900 in an example fluid jet system. The compartment 900 contains, among several components, an abrasives holding tank 902, valves 904, and a manifold block 906. The abrasives holding tank 902 can be filled by pouring abrasive material into the tank access port 914.

The valves 904 are contained in the manifold block 906 and receive fluid input to the manifold block 906 at an intake port 908 via an output line 910 from the high pressure pump (see pump 332 in FIG. 7) in the fluid jet base station. Electrical signal lines 912 carrying control signals from valve control module (see valve control 210 in FIG. 2) for opening and closing the valves 904. The manifold block 906 has different manifold geometries associated with each of the valves. In this manner, the pressures associated with the different flows can be preset to provide an identified abrasive material to primary fluid ratio. Different geometries may be embodied, for example, by a manifold orifice or channel having a different length and/or width from another manifold orifice or channel.

In the illustrated implementation, fluid pumped into the manifold block 906 is split into two flows, each flow traveling through a dedicated valve. The output of one valve is directed to the abrasives holding tank 902 via a first hose (not shown), and the output of the abrasives holding tank 902 is directed to a junction, where it is combined with a primary fluid flow that travels from the output of the other valve, through its associated manifold channel to the junction. The combination of the abrasives material from the tank 902 and the primary fluid flow is output from the lance during a cutting operation. If the valve coupled to the abrasives holding tank 902 is closed, then only the primary fluid flow is output from the lance.

Figure 10:
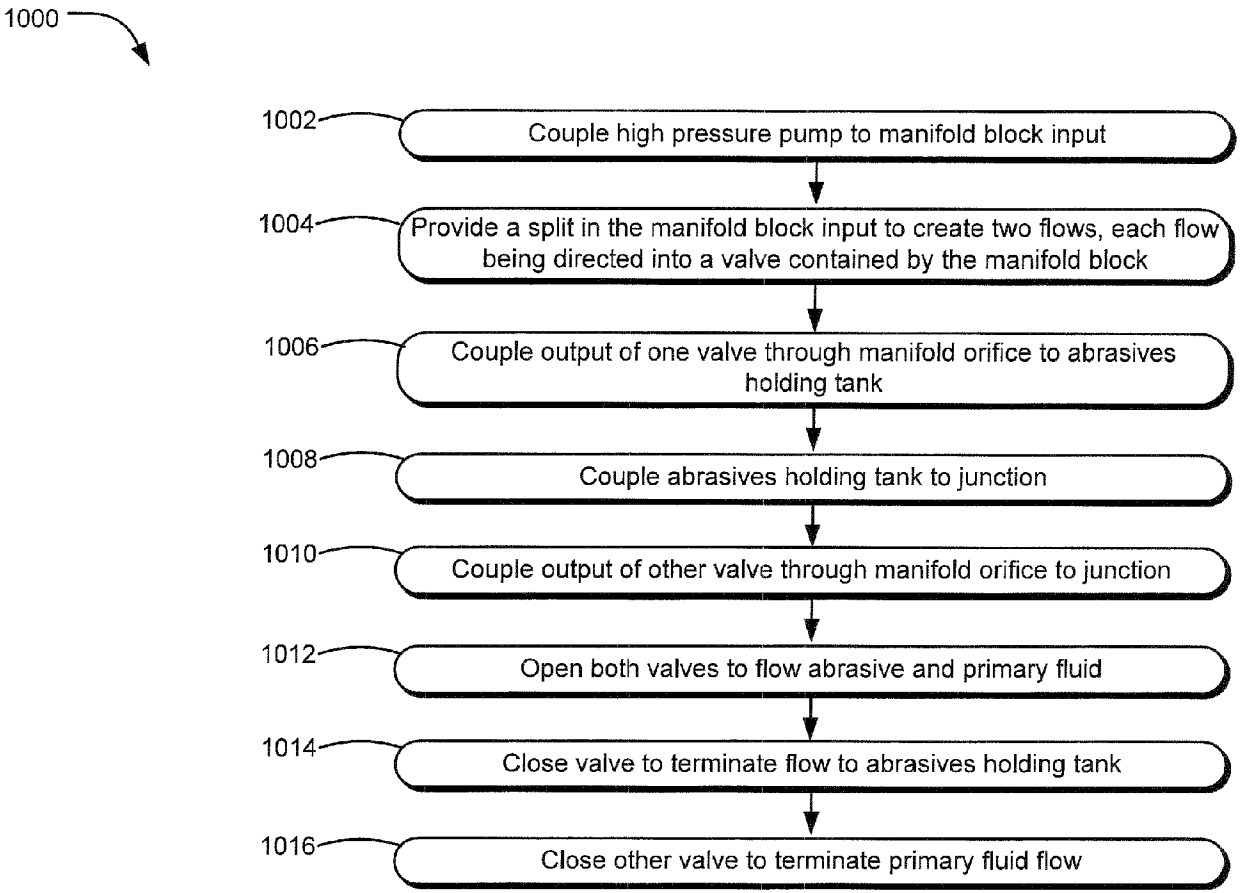
FIG. 10 illustrates example operations for using an example fluid jet system.

FIG. 10 illustrates example operations 1000 for using an example fluid jet system. A coupling operation 1002 couples the output of a high pressure pump to a manifold block input. A splitting operation 1004 provides a split in the manifold block input to create at least two fluid flows within the manifold, each flow being directed to a valve contained in the manifold block.

Another coupling operation 1006 couples the output of one valve through a first manifold channel and outlet pipe to an abrasives holding tank. Another coupling operation 1008 couples the output of the abrasives holding tank to a junction. Yet another coupling operation 1010 couples the output of the other valve through a second manifold channel and outlet pipe to the junction. The channel geometries associated with each valve are different. In one implementation, the diameters and/or length of the channels differ to provide fluid flow along two paths (e.g., one through the abrasives holding tank and the other bypassing the abrasives holding tank) at different pressures.

A control operation 1012 opens both valves to flow both abrasive material and primary fluid through the junction to the lance. Another control operation 1014 closes one of the valves to terminate the flow of abrasive material. Yet another control operation 1016 closes the other valve to terminate the flow of primary fluid.

Figure 11:
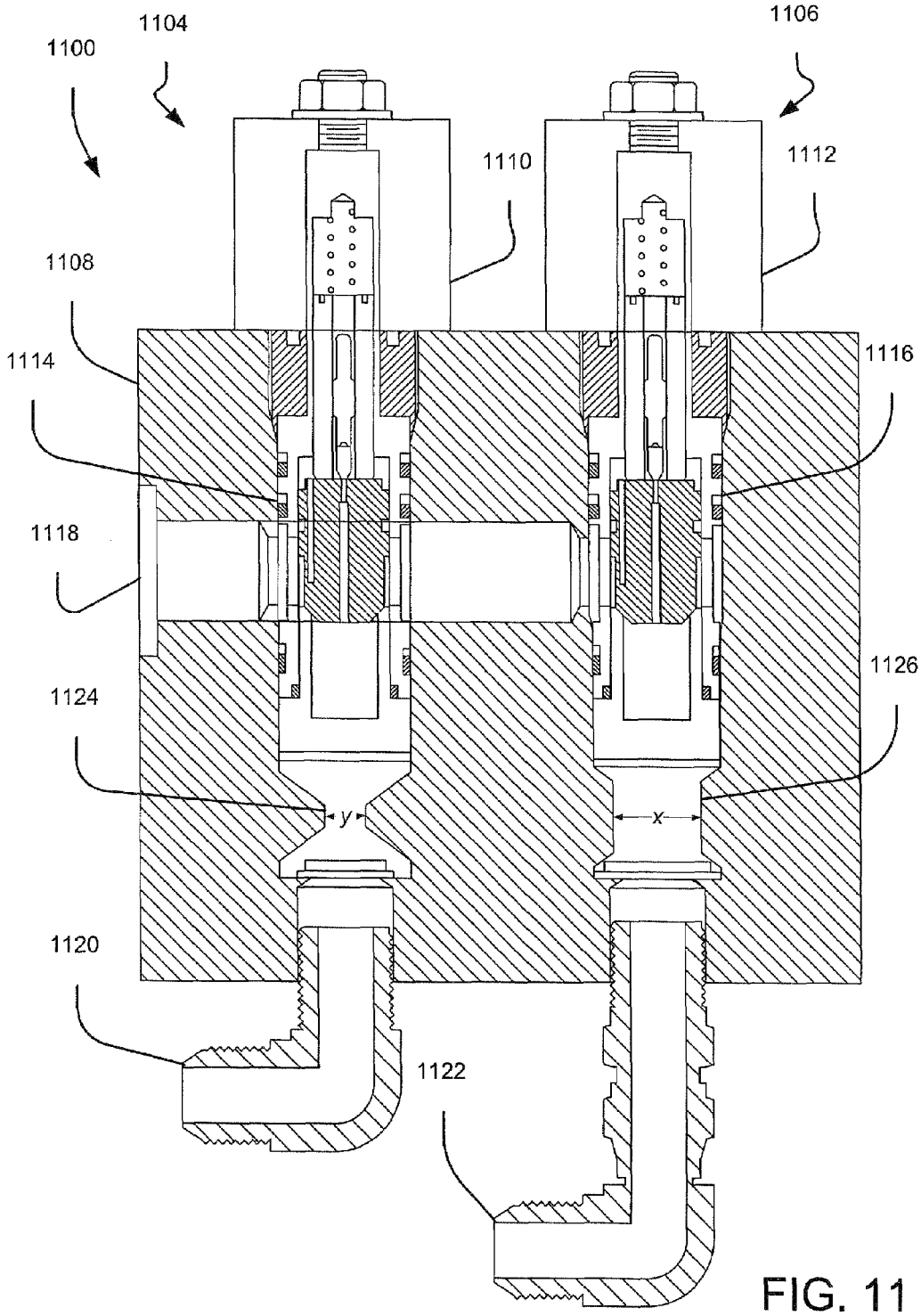
FIG. 11 illustrates a cross-sectional view of valves and a manifold block in an example fluid jet system.

FIG. 11 illustrates a cross-sectional view 1100 of valves 1104 and 1106 and a manifold block 1108 in an example fluid jet system. Each valve 1104 and 1106 includes a control block 1110 and 1112 respectively that responds to control signals from triggers in a lance. When a trigger is closed, the valve corresponding to that trigger opens, and when the trigger is opened, the valve corresponding to that trigger closes and ceases fluid flow.

In FIG. 11, the valves 1104 and 1106 are embodied by piston valves contained in the manifold block 1108, although it should be understood that different types and configurations of valves may be employed. The valve spools 1114 and 1116 are inserted into cavities in the manifold block 1108 and oriented to receive fluid through a manifold block inlet 1118 and to output fluid through outlet pipes 1120 and 1122. The manifold block inlet 1118 splits to feed both valves 1104 and 1106.

The manifold block 1108 is manufactured to include two preset channels 1124 and 1126, one channel for each valve 1104 and 1106. The channels 1124 and 1126 are manufactured to provide different geometries at the output of the valves. The different geometries influence the pressure of the fluid output by each of the valves 1104 and 1106. For example, although both valves shown in FIG. 11 are considered valves for ½ inch pipes, the manifold block 1108 is tooled to provide the preset channel 1126 having a different diameter x than the preset channel 1124, which has a diameter of y. If x>y, then the fluid flowing through the preset channel 1126 is under a lower pressure than the fluid flowing through the preset channel 1124. This disparity of pressures between the different flow paths allows the manufacturer to set a mixture ratio of abrasive material to primary fluid.

Alternatively or additionally, the geometries may be formed to have a different length. A longer length introduced more resistance and therefore more pressure in the flow circuit having the longer channel.

The embodiments of the invention described herein are implemented as logical steps in one or more computer systems. The logical operations of the present invention are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations making up the embodiments of the invention described herein are referred to variously as operations, steps, objects, or modules. Furthermore, it should be understood that logical operations may be performed in any order, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A fluid jet base station comprising:

a manifold configured to input a pressurized input fluid flow and to output at least two output fluid flows via at least two manifold channels at disparate pressures, wherein at least one of the manifold channels has a channel geometry preset to achieve a desired mixture ratio of an additive material to a primary fluid;

an additive holding tank having an input coupled to receive a first flow of the output fluid flows at a first pressure from the manifold and an output configured to output an output fluid flow containing the additive material; and a junction coupled to combine a second flow of the output fluid flows from the manifold and the output fluid flow from the additive holding tank at a second pressure.

2. The fluid jet base station of claim 1, wherein the manifold includes at least two valves, each valve regulating flow of one of the output fluid flows toward the junction.

3. The fluid jet base station of claim 2 wherein an output of each of the valves is coupled to one of the manifold channels, each manifold channel regulating fluid flow to a different pressure.

4. The fluid jet base station of claim 1 wherein the channel geometry includes a channel diameter through which fluid flows in the manifold.

5. The fluid jet base station of claim 1 wherein the channel geometry includes a channel length through which fluid flows in the manifold.

6. The fluid jet base station of claim 2 wherein the pressurized input fluid flow is split into at least two separate fluid flows within the manifold, each separate fluid flow being directed through a different one of the valves.

7. The fluid jet base station of claim 1 wherein the pressurized input fluid flow is split into at least two separate fluid flows within the manifold, one separate fluid flow being directed through the additive holding tank before combining with another separate fluid flow at the junction.

8. The fluid jet base station of claim 1 wherein the disparate pressures include a first pressure and a second pressure, wherein the first pressure is greater than the second pressure.

9. A method of operating a fluid jet system, the method comprising:

inputting a pressurized input fluid flow into a manifold;

outputting at least two output fluid flows from the manifold via at least two manifold channels at disparate pressures, wherein at least one of the manifold channels has a channel geometry preset to achieve a desired mixture ratio of an additive material to a primary fluid;

inputting a first flow of the output fluid flows to an additive holding tank at a first pressure;

outputting from the additive holding tank an output fluid flow containing the additive material; and combining a second flow of the output fluid flows from the manifold with the output fluid flow from the additive holding tank at a second pressure.

10. The method of claim 9 further comprising:

controlling the first flow and second flow using a separate valve in each output fluid flow, each valve located in the manifold.

11. The method of claim 10 wherein an output of each of the separate valves is coupled to one of the manifold channels, each manifold channel regulating fluid flow to a different pressure.

12. The method of claim 9 wherein the channel geometry includes a channel diameter through which fluid flows in the manifold.

13. The method of claim 9 wherein the channel geometry includes a channel length through which fluid flows in the manifold.

14. The method of claim 10 further comprising:

splitting the pressurized input fluid flow into at least two separate fluid flows within the manifold, each separate fluid flow being directed through a different one of the separate valves.

15. The method of claim 9 further comprising:

splitting the pressurized input fluid flow into at least two separate fluid flows within the manifold, one separate fluid flow being directed through the additive holding tank before combining with another separate fluid flow at a junction.

16. The method of claim 9 wherein the disparate pressures include a first pressure and a second pressure, wherein the first pressure is greater than the second pressure.

17. The fluid jet base station of claim 1, wherein the additive material is an abrasive material and the additive holding tank is an abrasives holding tank.

18. The fluid jet base station of claim 1, wherein the additive material is foam and the additive holding tank is a foam holding tank.

19. The method of claim 9, wherein the additive material is an abrasive material and the additive holding tank is an abrasives holding tank.

20. The method of claim 9, wherein the additive material is foam and the additive holding tank is a foam holding tank.

* * * * *